US005947303A

United States Patent [19]

Robolin

[11] Patent Number: 5,947,303

[45] Date of Patent: Sep. 7, 1999

[54] DISPLAY AND DISPENSING SYSTEM FOR BOTTLES

[75] Inventor: Claude J. Robolin, Lavonia, Ga.

[73] Assignee: RHC/ Spacemaster Corporation, Lavonia, Ga.

[21] Appl. No.: 09/049,798

[22] Filed: Mar. 27, 1998

[51] Int. Cl.[6] ..... A47F 5/00

[52] U.S. Cl. ..... 211/59.2; 211/74; 221/289; 221/298

[58] Field of Search ..... 211/74, 59.2; 221/298, 221/289; 312/42, 45, 72, 73

[56] References Cited

U.S. PATENT DOCUMENTS

| | | | |
|---|---|---|---|
| 5,586,665 | 12/1996 | Brousseau | 211/74 X |
| 5,586,687 | 12/1996 | Spamer et al. | 211/74 X |
| 5,706,958 | 1/1998 | Spamer | 211/74 |
| 5,706,978 | 1/1998 | Spamer et al. | 211/59.2 X |
| 5,718,341 | 2/1998 | Robertson | 211/74 X |
| 5,755,341 | 5/1998 | Spamer | 211/74 X |
| 5,788,091 | 8/1998 | Robertson et al. | 211/74 X |

*Primary Examiner*—Robert W. Gibson, Jr.
*Attorney, Agent, or Firm*—Robert F. I. Conte; Lee, Mann, Smith, McWilliams, Sweeney & Ohlson

[57] ABSTRACT

A consumer display and dispensing rack having a front and a back, and a container rail inclined downwardly and forwardly from the back to the front for supporting a series of bottles thereon is disclosed. The rail provides a spaced apart pair of support flanges for supporting a series of bottles adjacent their tops. Adjacent the front end of the rail, a control lever is pivotally mounted to intercept and engage the tops of bottles supported on the support flanges as they reach the front end of the rail to control removal of bottles from the rail and to control movement of succeeding bottles as they slide along the support flanges.

10 Claims, 5 Drawing Sheets

DISPLAY AND DISPENSING SYSTEM FOR BOTTLES

BACKGROUND OF THE INVENTION

A variety of systems have been developed for displaying beverage containers in retail establishments and for facilitating their dispensing to consumers one at a time. Typically, such systems employ shelving, such as inclined shelving, which will allow the removal of containers from the front by consumers and which will allow following containers to be easily moved forwardly for subsequent removal by another or a succeeding customer.

At present, a number of beverage containers such as bottles have enlarged neck zones upon which the containers may be supported. Such zones may be formed on the container itself or may instead be formed integrally with the closure or cap for the container.

It would be desirable to provide a system for displaying such containers and for facilitating the automatic movement of succeeding containers forwardly as one is removed, as by a consumer. It would be desirable that such a system would also prevent the unwanted forward movement of succeeding containers until such time as they were intended to be removed, as by a consumer.

SUMMARY OF THE INVENTION

In accordance with the present invention, an improved display and dispensing system for bottles and method for displaying and dispensing bottles is provided.

A consumer display and dispensing rack having a front and a back, and a container rail inclined downwardly and forwardly from the back to the front for supporting a series of bottles thereon is provided. The rail has a front end and a back end, and defines a spaced apart pair of support flanges for supporting a series of bottles adjacent their tops. A control lever pivotally mounted on a pivot adjacent the front end of the rail is positioned to intercept and engage the tops of bottles supported on the support flanges as they reach the front end of the rail. The control lever has a front head end and a rear tail end, the front head end being heavier than the rear tail end, whereby the front head end pivots downwardly under the influence of gravity at the front end of the rail.

The head end is positioned relative to the rail and the series of bottles supported on the support flanges such that when a forwardmost bottle top underlies the head end, the top of the next succeeding bottle engages and is stopped by the tail end from moving forwardly and when a forwardmost bottle is moved forwardly and out of the rail, the head end pivots downwardly, the tail end elevates and the next succeeding bottle moves along the support flanges under the influence of gravity until it engages the control lever head and pivots the head end upwardly about the pivot thereby causing the tail end to move downwardly to engage and stop the next succeeding bottle top and bottle from moving forwardly.

In a preferred form, each bottle top comprises a cap threadingly secured to an associated bottle, and the cap defining a circular flange adapted to be supported on the rail support flanges. Desirably, the control lever head end defines a lower surface which is positioned to engage and be pivoted upwardly by the bottle tops, thereby to move the tail end downwardly to engage and stop a next succeeding bottle top. Preferably, the rack includes stop means at the front end of the rail and positioned to cooperate with the control lever to stop a bottle at the front end of the rail thereby to position a bottle for manipulation and removal by a consumer.

The rack may comprise vertical frame members, transverse frame members and side frame members, and the container rails are mounted on the transverse frame members. Desirably, the display rack comprises a plurality of side-by-side downwardly and forwardly inclined rails, each having a control lever.

A method of controlling the dispensing of bottles comprising utilizing the consumer display and dispensing rack for bottles is also disclosed.

Further objects, features and advantages of the present invention will become apparent from the following description and drawings.

DETAILED DESCRIPTION

Figure 1:
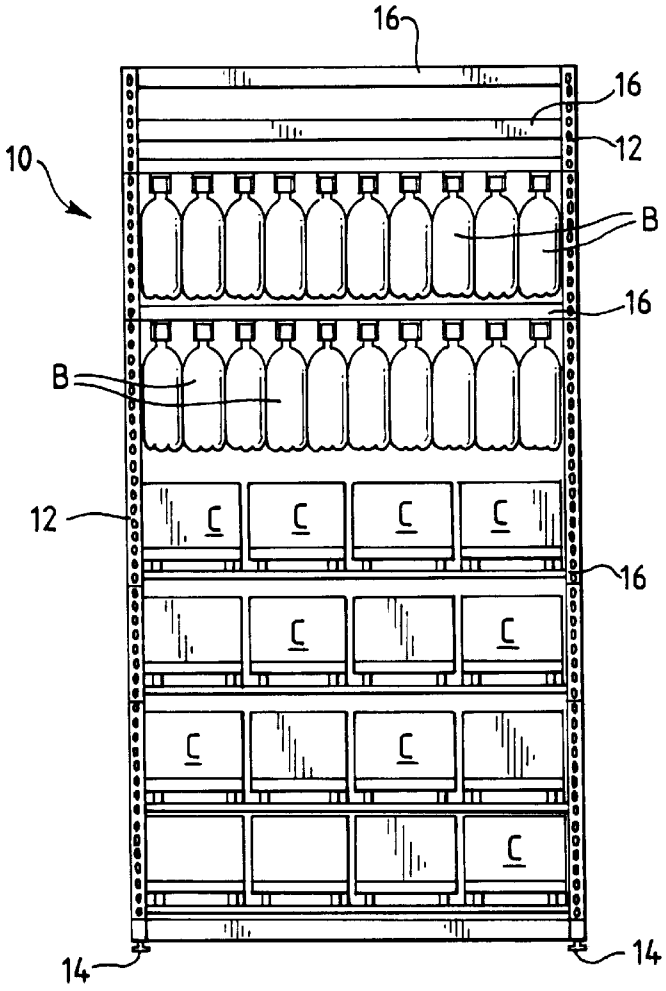
FIG. 1 is a front elevational view of a display and dispensing system in accordance with the present invention.

Referring now to the drawings, a display and dispensing system of the present invention for displaying beverage containers and for facilitating their dispensing to consumers includes a display rack 10 comprising suitable vertical frame members 12, support feet 14 and transverse frame members 16 disposed at the front and rear. Suitable connecting formations (not shown) for removably securing the members 10 and 16 may be provided as well. Side frame members 18 are provided to connect the front and rear vertical frame members 12, thereby to integrate the structural members of the display rack 10 and to provide a stable, satisfactorily rigid assembly.

The lower regions of the rack 10 may be used to display cartons C of beverage containers, such as six-packs of cans, twelve-packs of cans, multi-pack cartons of bottles, etc.

Figure 2:
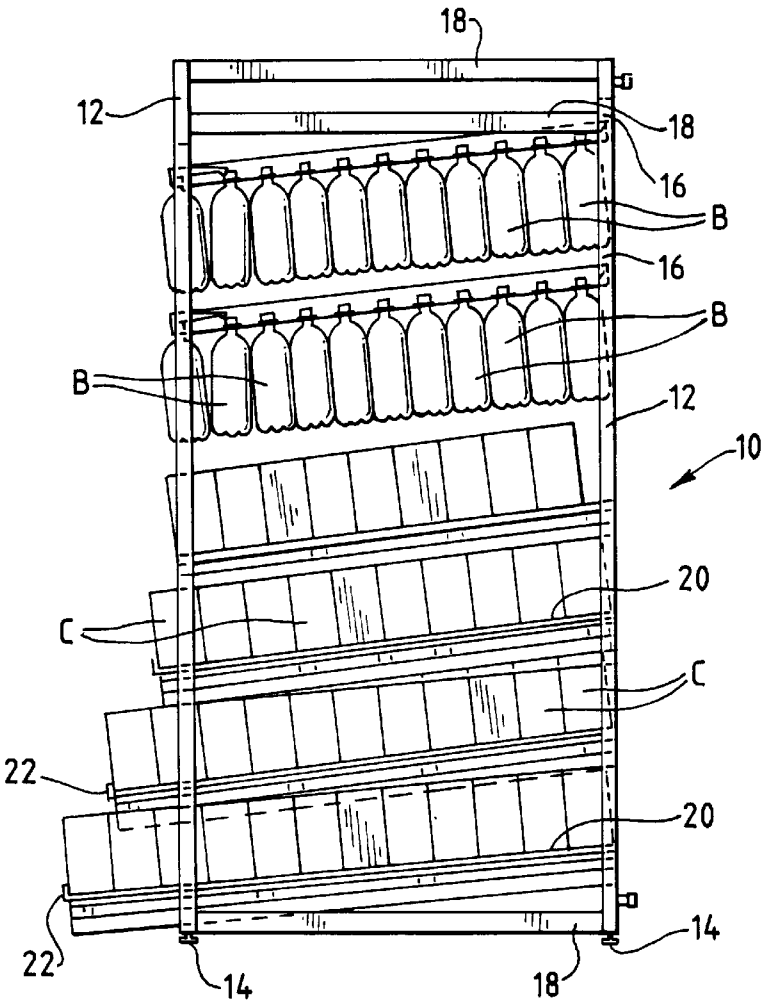
FIG. 2 is a side elevational view of the display and dispensing system of FIG. 1.
Figure 3:
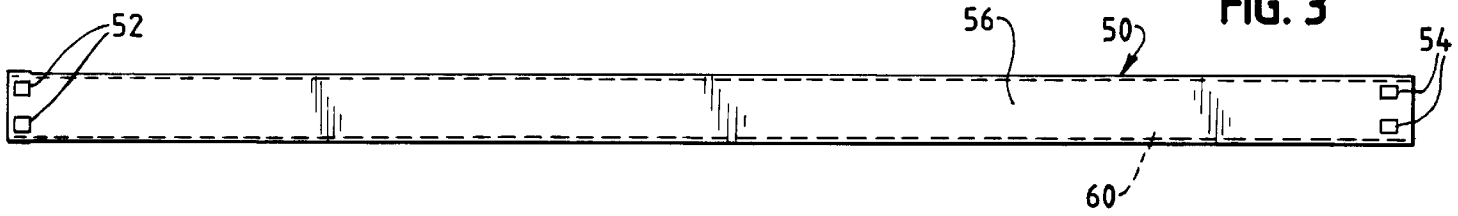
FIG. 3 is a plan view of a rail of the display and dispensing system of FIG. 1.

As best seen in FIGS. 1 and 2, cartons C are supported on inclined shelves 20 which may comprise roller bearings upon which the cartons are seated. Because of their weight, the cartons C move forwardly on the roller bearings until the forward-most ones of the cartons C engage a shelf stop or lip 22. To remove a carton, a consumer need only slightly elevate the carton C to be selected above a lip 22 and pull the carton C forward. The next succeeding carton C will then roll forwardly on the roller bearings until it is stopped by a confronting lip 22. As shown in FIGS. 1 and 2, the number of rows of cartons C may be four, although other rack widths and carton arrays may be used as well.

The upper regions of the display rack 10 are adapted for displaying and dispensing beverage containers, such as bottles. The bottles B, in the exemplary embodiment, are shown as two-liter, carbonated beverage bottles comprising a conventional, plastic container 100 and an associated plastic closure 102 for sealingly closing the container. These containers may be viewed as having enlarged neck zones, in this case being provided by the closure, and in particular by the enlarged flange formed on the closure.

As best seen in FIGS. 13–16, the closure 102 is shown as comprising a conventional internally threaded cap 104 and an outwardly projecting flange 106. Flange 106 may be circular. In one form, the container 100 may be of a conventionally used plastic material and the closure 102 may be formed of a conventionally used plastic material. A typical two-liter container is about 4-11/32 inches in diameter. The closure 102 is about 1-3/16 inches in diameter and about 13/16 inch in height. The flange 106 is about 1-7/16 inches in diameter and is about 1/16 inch thick. As is the conventional practice in manufacturing closures, the material of which the closure 102 is made is of sufficient strength and rigidity to easily support the weight of filled bottles B, as well as any shock loads and stresses placed on the closure 102 and the flange 106 without damaging the closures or associated containers, or their sealed relationships.

Referring again to FIGS. 1 and 2, it will be seen that the upper regions of the rack 10 mount a series of parallel guide and supporting channels or rails 50 which incline forwardly and downwardly within the rack 10. In the embodiment of FIGS. 1 and 2, the rails 50 are twenty in number. There are two banks of ten rails each, one above the other. In this embodiment, each bank is adapted to support two-liter containers, although it will be apparent that other banks and rails 50 adapted for other like containers, such as, for example, one-half liter and three liter containers may be used as well.

Each rail 50 is adapted to be secured to the rack 10 by support formations such as front hooks 52 and rear hooks 54. Hooks 52 and 54 are positioned to engage front and rear transverse frame members 16 which capture and integrate the banks of rails 50 at their fronts and rears. The hooks 52, 54 serve to fix the respective elevations of the fronts and rears of the rails 50 for reasons which will become apparent.

Each rail 50 comprises a top 56, integrally formed sides 58 and inwardly projecting bottom flanges 60. Flanges 60 are spaced apart a distance slightly greater than the diameter of the neck 101 of the container 100 below the threads of the container and immediately adjacent the flange 106 of the closure 102. As such, bottles B may move easily from the rear of a rail 50 to the front of a rail 50 and along and relative to the flanges 60. For two-liter bottles, the distance between the confronting edges of flanges 60 is about 1.14 inches, the width of rails 50 is about 2.0 inches and the flanges 60 project inwardly about 0.43 inch from their sides 58.

Figure 4:
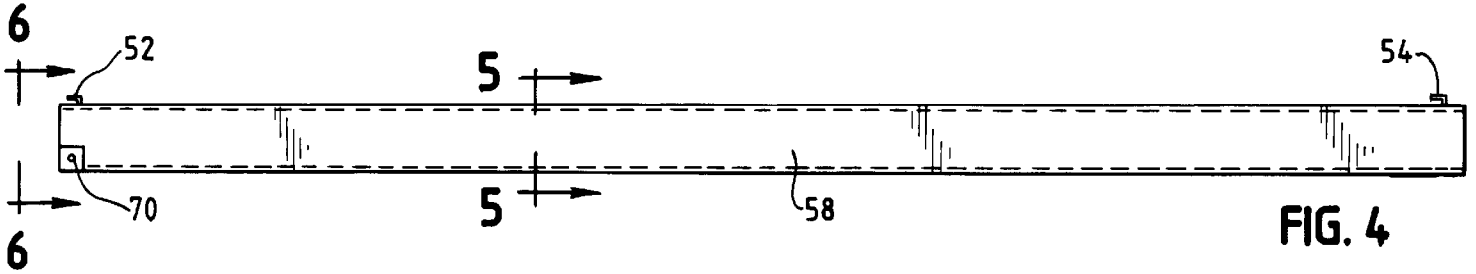
FIG. 4 is a side elevational view of FIG. 3.
Figure 7:
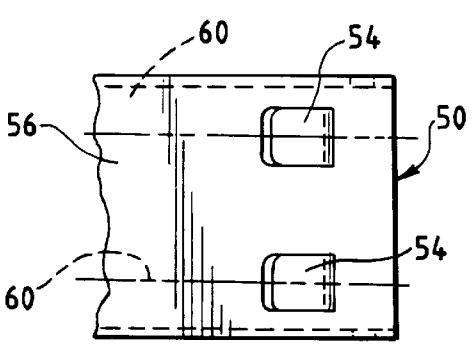
FIG. 7 is an enlarged view of a portion of FIG. 3.
Figure 6:
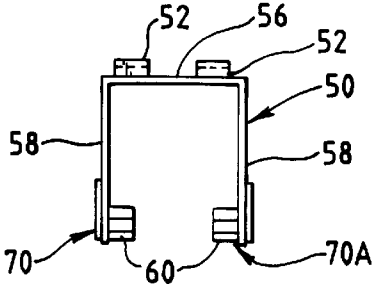
FIG. 6 is a front elevational view taken substantially along line 6—6 of FIG. 4.
Figure 5:
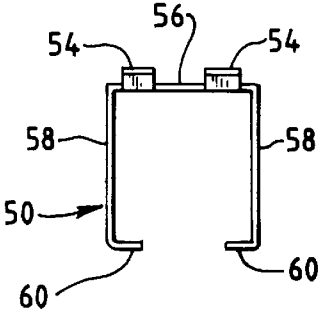
FIG. 5 is a cross-sectional view taken substantially along line 5—5 of FIG. 4.
Figure 8:
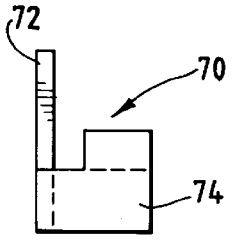
FIG. 8 is a front view of a stop element of FIG. 6.
Figure 9:
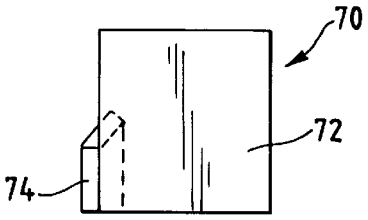
FIG. 9 is a side elevational view of FIG. 8 taken from the right of FIG. 8.
Figure 10:
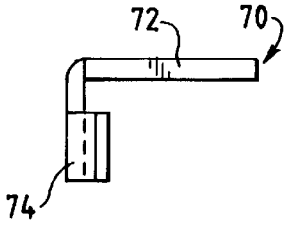
FIG. 10 is a top plan view of FIG. 8.
Figure 11:
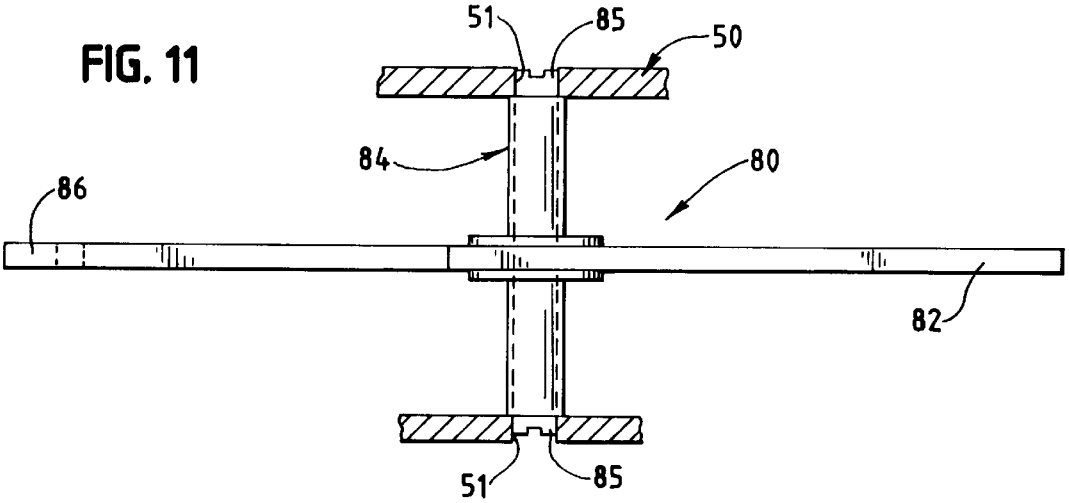
FIG. 11 is a plan view of a control lever of the display and dispensing system of FIG. 1 and showing how it is mounted to an associated rail.

The fronts of rails 50, as best seen in FIGS. 4 and 6, mount stops 70, 70A. As shown in FIGS. 8–10, stops 70, 70A may be welded to the sides 58 immediately adjacent to the fronts of the rails 50 and adjacent the associated flanges 60. Each stop 70, 70A comprises a mounting plate 72 by which the stop is welded to the rail 50 at the outside of a side 58. Extending inwardly therefrom on the inside of side 58 is an inwardly projecting plate 74 having a lower, generally vertical segment and an upper, somewhat rearwardly inclined segment. Stop 70A at the right side, as viewed in FIG. 6, is a mirror image of stop 70. As will appear, stops 70, 70A together cooperate with a rail 50 and a bottle B to control to forward movement when a bottle B reaches the front of a rail 50.

Referring now to FIGS. 13–16, a row or series of bottles B is supported in a rail 50 by their closures 102. In particular, bottles B are supported and suspended on closure flanges 106 by rail flanges 60, with the container neck 101 10 being disposed between the confronting edges of rail flanges 60. The rail 50 may desirably be inclined forwardly and downwardly at 5.5 degrees from the horizontal.

Figure 13:
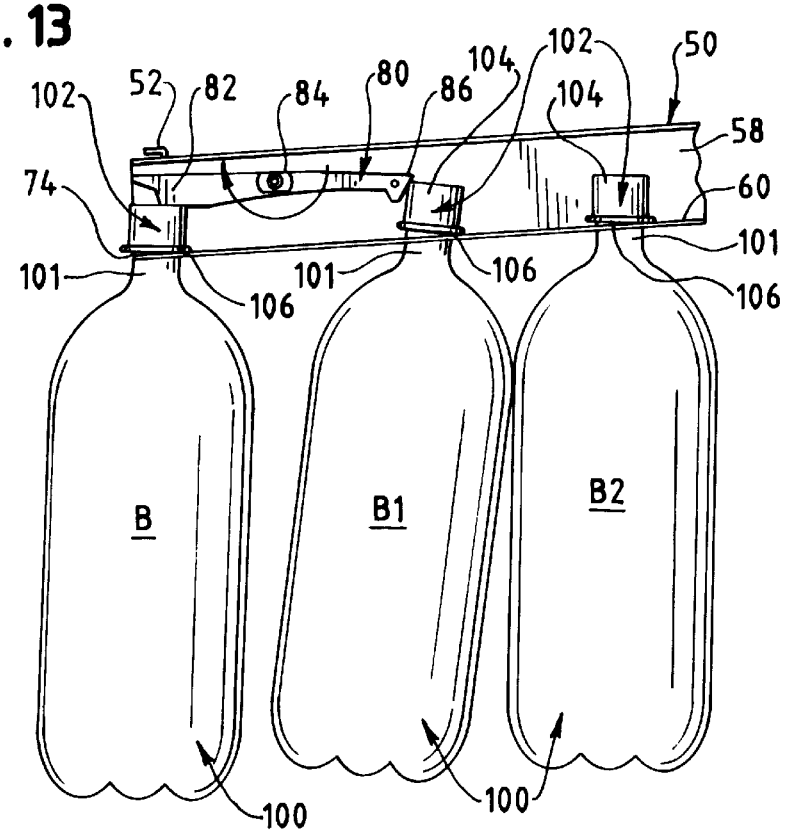
FIG. 13 is a fragmentary side view of a rail and associated control lever of FIG. 1 in a position of rest.

Referring first to FIG. 13, a rail 50 and an associated series of bottles B, namely bottles B, B1 and B2, are shown as being at rest following the earlier removal of a bottle B. The front bottle B is seated with its closure flange 106 supported against the stop plates 74 of stops 70, 70A, and with the head 82 of control lever 80 positioned against the top of the cap 104 of closure 102. In that position of oscillation of control lever 80 about pivot 84, the tail 86 of control lever 80 is disposed to intercept and engage a front edge of the next succeeding closure 102. This prevents the next succeeding bottle, bottle B1, from moving forward along rail 50 and, in turn, serves also to prevent other bottles B in the row (such as bottle B2) from moving forward along the rail 50. Thus, the row or series of bottles B, B1, B2, etc. supported on the rail 50 may be considered to be at rest.

Figure 14:
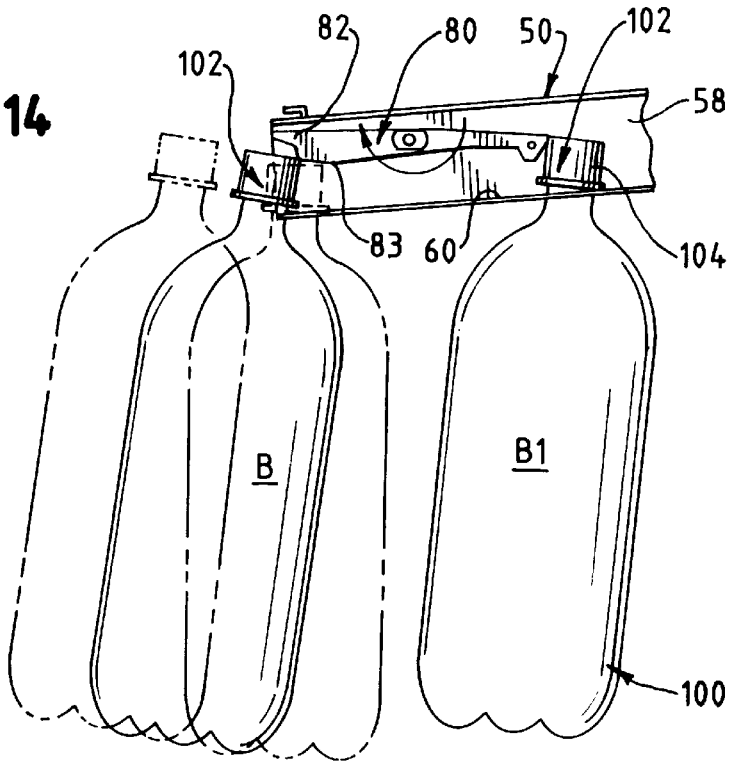
FIG. 14 is a view like FIG. 13, but with a container in the process of being removed from the rail.
Figure 15:
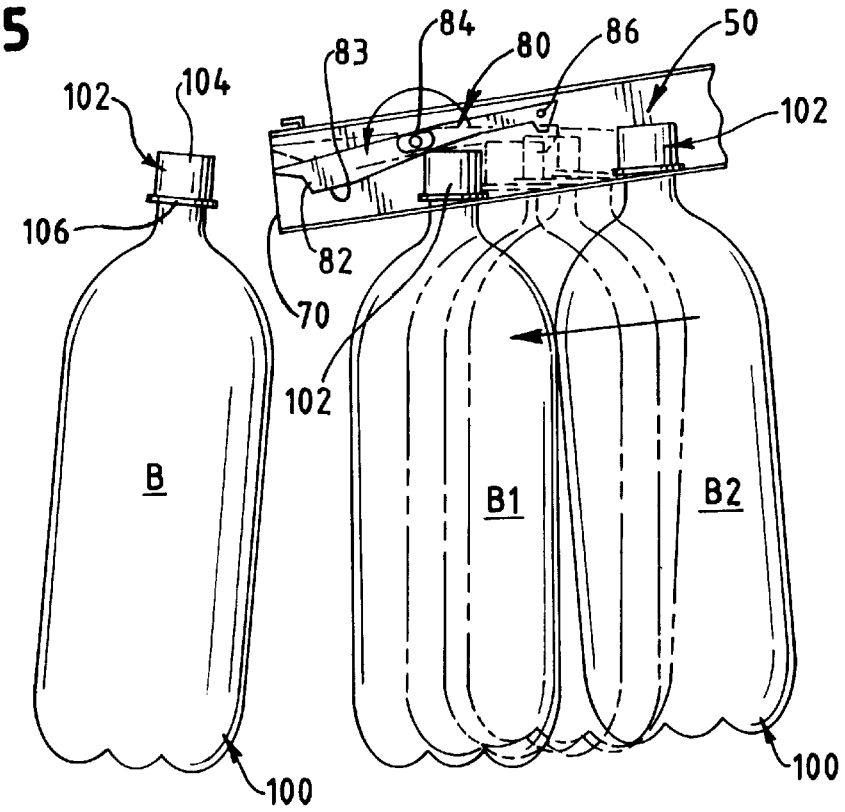
FIG. 15 is a view like FIG. 13, just after a container has been removed from the rail.

As shown by FIG. 14, when a front bottle B is to be removed, it is rotated forwardly about the rear edge of the flange 106 of closure 102. This causes the head 82 and front of the control lever 80 to elevate slightly, further resisting forward movement of succeeding bottles B1, etc., via the tail 86 of control lever 80. The forward rotation of bottle B elevates the flange 106 of the forward bottle relative to the stops 70, 70A and their associated plates 74, thus effectively releasing the bottle B to be pulled forwardly out of the rail 50, as is illustrated by the transition from FIG. 14 to FIG. 15.

Figure 16:
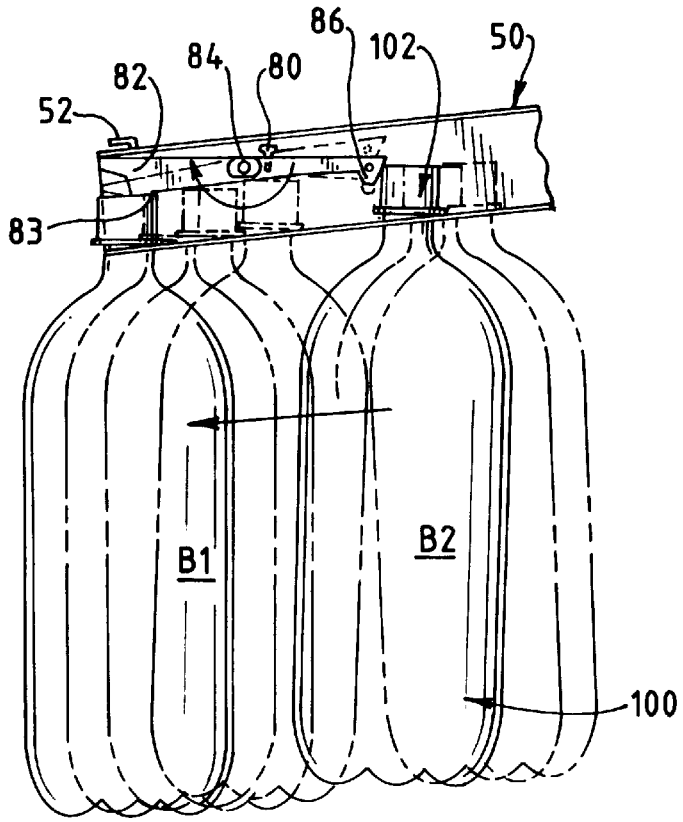
FIG. 16 is a view similar to FIG. 13.

Because the head 82 and the portion of the control lever 80 forward of the pivot 84 is heavier than the tail 86 and the portions of the lever 80 rearward of the pivot 84, when the bottle B has been removed (FIG. 15), the head 82 oscillates and drops (FIG. 15) due to gravity, allowing succeeding bottles B1, etc. to wobble and slide forwardly along rail 50 due to their own weight and under the influence of gravity until the next succeeding bottle, bottle B1, and its closure 102 pushes the head 82 upwardly via the lower head surface 83 and the flange 106 engages the stops 70, 70A, causing bottles B1 and succeeding bottles to assume positions such as those illustrated in FIG. 13. That also brings the control lever tail 86 to a position where it prevents the succeeding bottles B1, B2, etc. from continuing their travel forwardly of rail 50, all as is shown by FIG. 16 in conjunction with FIG. 13.

In the manner described, one bottle B may be removed at a time from a rail 50, and succeeding bottles are prevented from moving forward for release and dispensing in a rail 50, except one at a time.

Control lever pivot 84 may be hollow and threaded to receive a pair of set screws 85 by which it is secured to a rail 50. Set screws 85 are threaded into the pivot 84 through opposed openings 51 in the sides of rail 50. The outer ends of the screws remain in the openings. When the control lever requires servicing or replacement, the screws 85 are screwed out and another control lever is secured by screws 85.

Figure 12:
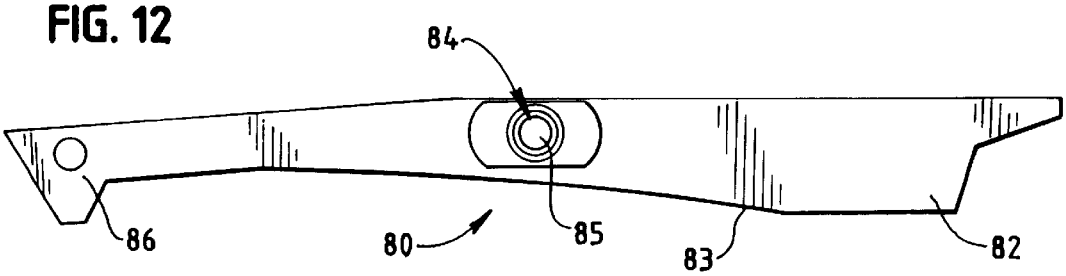
FIG. 12 is a side elevational view of FIG. 11.

In a preferred form, the control lever is 6.0 inches long with the center of the pivot 84 exactly in the longitudinal center of the control lever. The control lever may be laser-cut from a plate of 10 gauge carbon rolled steel and to a configuration in side elevation substantially identical to that shown in FIG. 12.

It will be apparent to those skilled in the art that modifications may be made in the illustrated embodiment without departing from the spirit and scope of the invention. Accordingly, it is not intended that the invention be limited except as may be necessary in view of the appended claims.

What is claimed is:

1. A consumer display and dispensing rack for bottles, said rack having a front and a back, and a container rail inclined downwardly and forwardly from said back to said front for supporting a series of bottles for movement from said back to said front thereon, said rail having a front end and a back end and defining a spaced apart pair of support flanges for supporting said series of bottles adjacent their tops, a control lever pivotally mounted on a pivot adjacent the front end of said rail and positioned to intercept and engage the tops of bottles supported on said support flanges as they reach the front end of said rail, said control lever having a front head end and a rear tail end, and said pivot being located approximately equidistant from said front head end and said tail end, said front head end having a relatively thicker portion along the longitudinal length thereof, and said tail end having a relatively narrower portion along the longitudinal length thereof, said front head end being heavier than said rear tail end whereby said front head end pivots downwardly under the influence of gravity at the front end of said rail, said head end being positioned relative to said rail and said series of bottles supported on said support flanges such that when a forwardmost bottle top is positioned to underlie said head end, the top of the next succeeding bottle engages and is stopped by said tail end from moving forwardly and when a forwardmost bottle is moved forwardly and out of said rail, said head end pivots downwardly, said tail end elevates and the next succeeding bottle may move along said support flanges under the influence of gravity until it engages said control lever head end and pivots said head end upwardly about said pivot thereby causing said tail end to move downwardly to engage and stop the next succeeding bottle top and bottle from moving forwardly.

2. A display and dispensing rack for bottles in accordance with claim 1, and wherein each said bottle top comprises a cap threadingly secured to an associated bottle, said cap defining a circular flange adapted to be supported on said rail support flanges.

3. A display and dispensing rack for bottles in accordance with claim 1, and wherein said control lever head end defines a lower surface which is positioned to engage and be pivoted upwardly by said bottle tops, thereby to move said tail end downwardly to engage and stop a next succeeding bottle top.

4. A display and dispensing rack for bottles in accordance with claim 1, and wherein said rack includes stop means at the front end of said rail, said stop means being positioned to cooperate with said control lever to stop a bottle at the front end of said rail thereby to position a bottle for manipulation and removal by a consumer.

5. A display and dispensing rack for bottles in accordance with claim 1, and wherein said rack comprises vertical frame members, transverse frame members and side frame members, and said container rails are mounted on said transverse frame members.

6. A display and dispensing rack for bottles in accordance with claim 1, and wherein said display rack comprises a plurality of side-by-side downwardly and forwardly inclined rails, each having a said control lever.

7. A method of controlling the dispensing of bottles comprising providing a consumer display and dispensing rack for said bottles, said rack having a front and a back, and a container rail inclined downwardly and forwardly from said back to said front, said rail having a front end and a back end and defining a spaced apart pair of support flanges for supporting a series of bottles adjacent their tops, providing a control lever pivotally mounted on a pivot adjacent the front end of said rail and positioned to intercept and engage the tops of bottles supported on said support flanges as they reach the front end of said rail, said control lever having a front head end and a rear tail end, said pivot being located approximately equidistant from said front head end and said tail end, said front head end having a relatively thicker portion along the longitudinal length thereof, and said tail end having a relatively narrower portion alone the longitudinal length thereof, said front head end being heavier than said rear tail end whereby said front head end pivots downwardly under the influence of gravity at the front end of said rail, positioning said head end relative to said rail and said series of bottles supported on said support flanges such that when a forwardmost bottle top is moved to underlie said head end, the top of the next succeeding bottle engages and is stopped by said tail end from moving forwardly, and such that when a forwardmost bottle is moved forwardly and out of said rail, said head end pivots downwardly, said tail end elevates and the next succeeding bottle moves along said support flanges under the influence of gravity until it engages said control lever head end and pivots said head end upwardly about said pivot thereby causing said tail end to move downwardly to engage and stop the next succeeding bottle top and bottle from moving forwardly.

8. The method of claim 7, and wherein each said bottle top comprises a cap defining a circular flange adapted to be supported on said rail support flanges, and the further step of supporting a said series of said bottles by said circular flanges on said support flanges.

9. The method of claim 7, and wherein said control lever head end defines a lower surface which is positioned to engage said bottle tops, and the further step of engaging said lower surface to be pivoted upwardly by said bottle tops, thereby to move said tail end downwardly to engage and stop a next succeeding bottle top.

10. The method of claim 7, and wherein said rack includes stop means at the front end of said rail, said stop means being positioned to cooperate with said control lever to stop a bottle at the front end of said rail thereby to position a bottle for manipulation and removal by a consumer.

* * * * *

UNITED STATES PATENT AND TRADEMARK OFFICE

CERTIFICATE OF CORRECTION

PATENT NO. : 5,947,303

DATED : September 7, 1999

INVENTOR(S) : Claude J. Robolin

It is certified that error appears in the above-identified patent and that said Letters Patent is hereby corrected as shown below:

Column 6, line 29, delete "alone" and insert --along--

Signed and Sealed this

Twenty-fifth Day of July, 2000

*Attest:*

*Attesting Officer*

Q. TODD DICKINSON

*Director of Patents and Trademarks*